US005224857A

United States Patent [19]

Schultz et al.

[11] Patent Number: 5,224,857

[45] Date of Patent: Jul. 6, 1993

[54] RADIANT TUBE ARRANGEMENT FOR HIGH TEMPERATURE, INDUSTRIAL HEAT TREAT FURNACE

[75] Inventors: Thomas J. Schultz, Maumee; Timothy J. Kuhn, Toledo, both of Ohio

[73] Assignee: Gas Research Institute, Chicago, Ill.

[21] Appl. No.: 921,117

[22] Filed: Jul. 29, 1992

Related U.S. Application Data

[62] Division of Ser. No. 739,081, Aug. 1, 1991, Pat. No. 5,163,416.

[51] Int. Cl.[5] ..... F27B 3/22

[52] U.S. Cl. ..... 432/175; 432/205; 432/209; 432/241; 126/92 R

[58] Field of Search ..... 126/92; 432/205, 209, 432/175, 241

[56] References Cited

U.S. PATENT DOCUMENTS

| | | | |
|---|---|---|---|
| 3,850,574 | 11/1974 | Namba | 432/205 |
| 4,596,526 | 6/1986 | Soliman | 432/205 |
| 4,787,844 | 11/1988 | Hemsath | 432/205 |
| 4,802,844 | 2/1989 | Kuhn et al. | 432/126 |
| 4,854,860 | 8/1989 | Hemsath | 432/205 |
| 4,963,091 | 10/1990 | Hoetzl et al. | 432/176 |
| 5,074,782 | 12/1991 | Hoetzl et al. | 432/209 |
| 5,127,827 | 7/1992 | Hoetzl et al. | 432/175 |

OTHER PUBLICATIONS

GRI-88/0159; Table of Contents, List of Tables, Appendices, pp. 38-43, 58-68, 72-77.

*Primary Examiner*—Henry C. Yuen

*Attorney, Agent, or Firm*—Body, Vickers & Daniels

[57] ABSTRACT

A standard atmosphere furnace constructed of a steel casing formed as a cylinder with fibrous insulation attached is operated as a vacuum furnace. A plurality of radiant, fuel-fired ceramic heat tubes positioned in a centered but circumferentially spaced arrangement provides heat input to the furnace to permit it to operate at high, vacuum associated temperatures. The ceramic tubes are vacuum sealed to the furnace case by an elastomer seal/water jacket arrangement which uses an outboard clamp arrangement to establish a ceramic-to-metal contact to permit thermal cooling and prevent tube-flange movement so that the integrity of the elastomer seal can be maintained. In addition, an articulated joint connector is provided so that the tube can be supported in a pivotable manner permitting thermal movement while reducing tube stress to prolonged tube life.

3 Claims, 5 Drawing Sheets

RADIANT TUBE ARRANGEMENT FOR HIGH TEMPERATURE, INDUSTRIAL HEAT TREAT FURNACE

This is a division of application Ser. No. 739,081 filed Aug. 1, 1991, U.S. Pat. No. 5,163,416.

This invention relates generally to high temperature industrial heat treat furnaces and more specifically to ceramic radiant heat tubes employed in such furnaces.

The invention is particularly applicable to and will be described with specific reference to a novel heat treat vacuum furnace employing a specific radiant tube position and a vacuum seal arrangement for the ceramic tubes. However, the invention has broader application and may be used in any high temperature, industrial heat treat furnace application.

INCORPORATION BY REFERENCE

Gas Research Institute, assignee of this invention and the party who funded the development work which gave rise to this invention, made available to the public in October, 1988 Report No. GRI-88/0159, authored by at least one of the inventors herein, and this report, since it discusses the feasibility of the furnace to which this invention relates, is incorporated herein by reference so that the specification herein need not define in great detail the furnace concepts and principles referred to herein. In addition, U.S. Pat. No. 4,802,844 is incorporated herein by reference so that details of a lift hearth mechanism need not be disclosed nor discussed in detail herein. In addition, U.S. Pat. No. 4,963,091 is incorporated herein by reference so that details of the furnace configuration need not be discussed in detail herein.

BACKGROUND

Certain heat treat processes and other related industrial heating applications such as brazing and sintering have, at least for certain applications, been traditionally conducted in industrial vacuum furnaces. Standard vacuum furnaces are constructed with a double wall configured in a cylindrical or spherical shape and employ a water jacket between the walls for cooling. This type of furnace is considerably more expensive than the conventional, box type standard atmosphere furnace which operates at atmospheric pressure and which is constructed by fibrous insulation attached to a furnace casing of sheet steel. Because of the water jacket construction in vacuum furnaces, heating is conducted in a vacuum furnace by means of graphite bars or electrodes surrounding the work and connected to a source of electrical power by electrical feedthroughs extending through the casing. In contrast, standard atmosphere furnaces typically use gas fired burners for heating which is a more cost efficient form of energy. Because the atmosphere within a standard atmosphere furnace must be precisely controlled, high temperature, standard atmosphere furnaces indirectly heat the work (i.e. heat by radiation for temperatures in excess of about 1500° F.) by means of burners which fire their products of combustion into radiant tubes which extend into the furnace. The radiant tubes may be either of the single-pass or the single-ended, double-pass type and the prior art is replete with numerous arrangements and configurations of such radiant tubes.

Until recently, components within standard atmosphere furnaces constructed of high alloyed steel limited the temperature at which such furnaces operated to a maximum of about 1750°-1850° F. Standard atmosphere furnaces which operate at such temperatures are referred to today as "high temperature" furnaces. Several years ago, Surface Combustion, Inc., under a contract funded by GRI developed an ultra-high temperature, standard atmosphere furnace now marketed by Surface under the brand name or trademark "ULTRA-CASE". Reference should be had to GRI U.S. Pat. No. 4,802,844 for a discussion of the deleterious effects temperature has on the life of steel alloys when the temperature begins to exceed 1850° F. In the '844 patent, a retractable hearth lift mechanism is employed to permit the furnace to operate at temperatures of about 2000° F. The limiting factor preventing furnace temperature in excess of about 2050° F., except for short durations, is the life of the high alloy steel radiant tube, i.e. thermal fatigue. That is, standard atmosphere furnace construction techniques using various ceramic types of insulation applied to a standard furnace casing sufficiently insulates the furnace to permit it be operated at temperatures in excess of 2000° F., i.e. at temperatures in the ranges approaching or equal to that utilized in vacuum furnace treatments. The limiting factor preventing higher furnace temperatures in gas fired, standard atmosphere furnaces is the radiant tube.

GRI Report 88/0159 discusses in depth the feasibility of using a "soft" vacuum defined as 10-250 torr coupled with furnace purging in a conventional atmosphere type furnace to perform those types of heat treat and heat treat type processes heretofore accomplished in vacuum furnaces where the work is heated in a "hard" vacuum below $10^{-1}$ torr. The report concludes that at "soft" vacuum levels of about 100 torr and at elevated temperatures of between about 1950°-2350° F. it is possible to metallurgically perform a number of such processes, which are detailed in the report. Thus, the report maintains that it is feasible to use a cost effective, modified atmosphere type furnace construction at high temperature under soft vacuum levels to perform certain types of industrial heat processes heretofore not thought possible in standard atmosphere furnaces. Standard atmosphere furnaces can be heated electrically. However, because of exposure to various furnace atmospheres (not present in "hard vacuum" furnaces), electrical heating elements have to be shielded, i.e. placed within radiant heat tubes. More importantly, operating cost efficiencies dictate that gas burners be used. Again, this means, because of furnace atmosphere composition requirements, radiant tubes.

Recently, ceramic radiant tubes constructed of silicon carbide have been introduced into the furnace art as replacements for steel alloy radiant tubes. While their commercial acceptance is not widespread, ceramic radiant tubes have much higher tensile strength at elevated temperatures (i.e. the temperature ranges under consideration) when compared to steel alloy radiant tubes. While investigation of the suitability of ceramic radiant tubes to the "soft" vacuum furnace application under discussion is still continuing, it is known that ceramic radiant tubes are extremely brittle. Special arrangements have to be undertaken when ceramic tubes are used in a horizontal placement position to minimize stress placed on the tubes. Furthermore, because of the elevated temperatures at which the furnace is operated, special consideration has to be given to the heat flux imparted by the tubes to the work so as to uniformly heat the work. In this regard, it is known by Surface Combustion, Inc. to position radiant tubes uniformly about work centered on the centerline of a cylindrical furnace similar to that used herein and operated under vacuum conditions. With respect to conventional vacuum furnaces, electric heating elements have been positioned to circumscribe the work and temperature uniformity is not as critical a problem as it is when point or line sources of radiant heat are used to heat the work by radiation. Finally, the ceramic radiant tube must be secured to the steel furnace casing in such a way which permits the tube to expand without incurring undue stress and at the same time, seal the tube so that leakage of deleterious oxygen into the furnace chamber which is under a vacuum does not occur.

With respect to vacuum sealing, it is well known in the vacuum furnace art to seal the furnace door by means of elastomer seals which are kept cool by a water jacket. It is also known, for example, by Surface Combustion's internal heat exchanger tubes marketed under the brand name or trademark INTRA-KOOL, to seal the tube at the casing by means of an elastomer seal adjacent a water jacket.

SUMMARY OF THE INVENTION

Accordingly, it is a principal object of the present invention to provide a preferred ceramic tube placement for an industrial heat treat furnace which employs a sealable arrangement for ceramic radiant heat tubes.

This object along with other features of the invention is achieved in an industrial, heat treat vacuum furnace which includes a steel casing to which fibrous insulation is attached and which defines a furnace chamber contained therein. A plurality of ceramic, radiant heat tubes extend into the chamber through the casing. Each radiant heat tube has a tube flange at one axial end positioned externally of the casing and the flange has an underside surface facing the casing and an outside face surface at the axial end thereof. A sealing mechanism capable of vacuum sealing the ceramic tube flange to the casing includes a support flange member engaging the tube flange's underside surface at its axial end face and the support flange member is secured to the casing at its opposite axial end. A burner flange member has an axial end face which sealingly engages the tube flange's outside face surface. The support flange member has a water jacket formed therein for flowing a coolant therethrough. At least one of the support flange's end face and the radiant tube's underside surface has a radially outward circumscribing groove formed therein and an elastomer seal is placed in the groove. A clamp mechanism is then provided for joining the support flange member and the burner flange member to compress the elastomer seal. Importantly, the clamp mechanism pulls the radially inwards surface of the support flange's end face and tube underside surface into ceramic-to-metal contact which prevents movement between radiant tube and support flange so that the elastomer seal will not be exposed to sliding surface contact which can adversely wear and affect the seal's ability to vacuum seal the connection. The ceramic-to-metal contact provides adequate thermal coupling thereby lowering the temperature of the radially outward portion of the ceramic flange which contacts the elastomer seal. This cooling is necessary to maintain the elastomer seal below the maximum normal operating temperature of the elastomer seal. Vacuum grease between the support flange end face and the radiant tube's underside surface is used to "fill in" any surface imperfections to assure solid area contact between ceramic tube and steel support flange. Alternatively, a non-ferrous metallic washer can be placed in the recess formed in the support flange.

In accordance with another aspect of the invention, the support flange member includes an expansion joint positioned between axial ends of the support flange member so that the support flange can move as the radiant tube thermally expands and contracts to thus relieve bending stress otherwise placed on the ceramic tube. Preferably, the burner flange member employs the same seal arrangement as the support flange member to seal the outside face surface of the radiant tube. The burner flange and support flange members are engaged by the clamp mechanism which is positioned radially outwardly from the elastomer seals for drawing the burner flange and support flange together under a spring tension bending movement to secure the desired radially inwardly positioned ceramic to metal contact while accomplishing compression of the elastomer seals to effect vacuum sealing.

In accordance with another feature of the invention, the burner flange has a support plate at its opposite axial end and an expansion joint is in between the support plate and the burner flange's axial end face which is in contact with the outside face surface of the radiant tube. Mounted to the support plate is a conventional burner. Significantly, at least two support legs extend between and are attached to the support plate and the furnace casing for fixing the longitudinal distance that the support and burner flanges with the radiant tube flange clamped therebetween extends from the casing. The clamp mechanism has first and second generally diametrically opposed recesses formed therein and first and second pivot pins fixed to the support legs are positioned within the first and second recesses. This pivoting pin connecting provides an articulated connection which supports the radiant tube at its flange in one direction or on one axis while permitting the radiant tube be unconstrained in movement in an orthogonal direction of motion or on another axis. In this manner, ceramic radiant tubes can be horizontally positioned and supported at the flange to relieve tube stress, while still being free to move in another direction to permit thermal expansion and alleviate thermal stress.

In accordance with still another aspect of the invention, a gas type flexible diaphragm may be optionally provided. The diaphragm circumscribes and encases the support flange and the burner flange over a portion thereof to define a sealed, annular space adjacent the radiant tube's flanged end. A purge gas inlet in fluid communication with the annular space provides a purge gas to the space at a slight pressure and a vent means for venting the purged gas from the annular space is also provided whereby, should some leakage occur during operation of the vacuum furnace, the leakage will not be detrimental to the furnace operation nor to the external environment surrounding the furnace.

In accordance with another feature of the invention, the sealing arrangement described can be readily applied whether the radiant tube be the single-ended, double-pass type or the single-pass type.

In accordance with still another feature of the invention, the steel casing is formed as a horizontally extending cylinder having a door at one end and a closed end wall at its opposite end. A ceramic, fibrous insulation attached to the casing provides insulation for the furnace chamber with the furnace chamber being cylindrical and having a longitudinally extending centerline about which the chamber is symmetrical. A hearth for supporting the work is secured to the casing and extends radially inwardly into the chamber a fixed distance such that the longitudinally extending centerline of the work is vertically offset from the longitudinally extending centerline of the furnace chamber. A plurality of radiant tubes are spaced in equal circumferential increments about the work's centerline so that the radiant tube adjacent the top portion of the work is closer to the work than the radiant tube adjacent the bottom portion of the work which is positioned between the hearth posts. This position, despite the offset arrangement, radiantly heats the work at substantially equal rates about all of its exposed surfaces. Specifically, only four (4) radiant tubes need be applied to achieve the high heat input at the desired uniform heating rate. In accordance with a more specific feature of the invention, the work is vertically movable to desired positions within the furnace chamber. A fan for providing convection heating is utilized to effect uniform heating of the work at low temperatures thus reducing the overall heating time. A microprocessor controls the hearth position, the fan speed and the pressure within the furnace chamber to provide a fast, uniform heat cycle utilizing both convection and radiant heat transfer.

Accordingly, it is an object of the subject invention to provide a furnace seal arrangement for a ceramic radiant heat tube.

It is another object of the invention to provide a seal arrangement for a ceramic radiant tube which allows free floating of the outside flanged end of the tube while providing a support for the tube's flanged end to relieve stress on the tube and avoid fracture.

Still another object of the invention is to provide in combination with a seal for a ceramic radiant tube, an articulated joint arrangement which allows the radiant tube to be mounted horizontally to the furnace.

Still yet another object of the invention is to provide a seal arrangement for a ceramic radiant heat tube which is effective to provide a seal against a vacuum drawn within the furnace to which the tube is mounted.

Still yet another object of the invention is to provide a seal and gas purge arrangement for a ceramic radiant tube which permits the tube to be used in a vacuum environment.

Still yet another object of the invention is to provide a fuel fired standard atmosphere furnace capable of operating at a soft vacuum because of the sealing arrangement employed for the ceramic radiant heat tubes used therein.

Still yet another object of the invention is to provide a preferred placement of radiant heat tubes in a cylindrical furnace to uniformly heat the work at high temperatures.

A still further object of the invention is to provide a fast heat cycle which is able to uniformly heat the work.

Still yet another object of the invention is to provide a ceramic radiant tube arrangement capable of operating at high temperatures in excess of 2050° F. in a standard atmosphere type construction furnace employing blanket, fibrous insulation.

These and other objects will become apparent from a reading of the Detailed Description section taken together with the drawings which will be described in the next section.

BRIEF DESCRIPTION OF THE DRAWINGS

The invention may take physical form in certain parts and arrangement of parts, a preferred embodiment of which will be described in detail and illustrated in the accompanying drawings which form a part hereof and wherein.

DETAILED DESCRIPTION OF THE INVENTION

Figure 1:
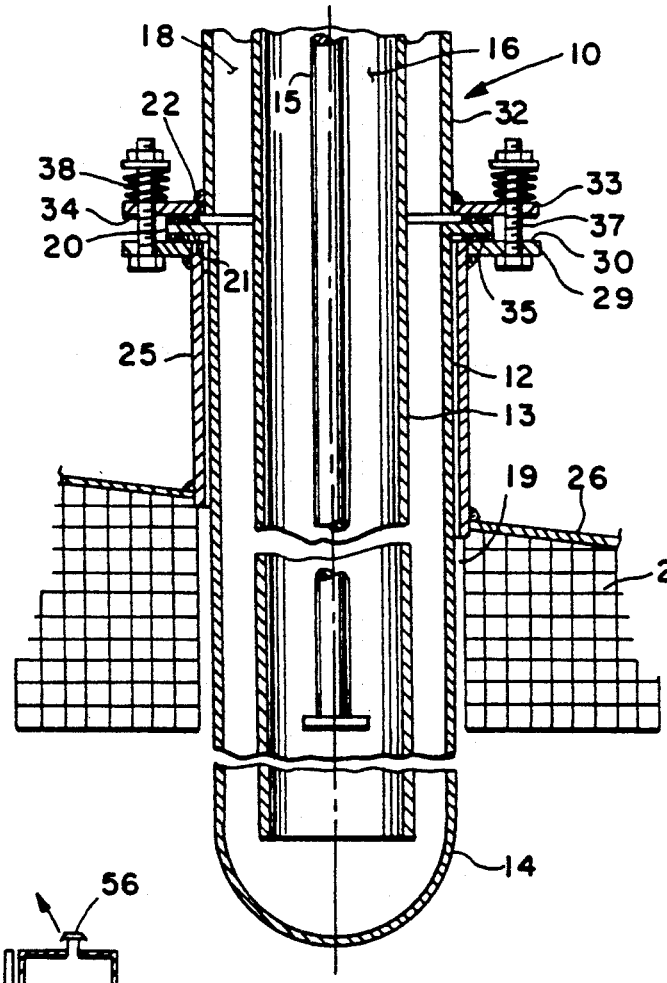
Fig. 1 PRIOR ART
FIG. 1 is a partial schematic, longitudinally-sectioned view of a prior art sealing arrangement for a ceramic radiant tube.

Referring now to the drawings wherein the showings are for the purpose of illustrating a preferred embodiment of the invention only and are not for the purpose of limiting the same, there is shown in FIG. 1 a partially sectioned, schematic representation of a prior art sealing arrangement employed for sealing a single-ended, double-pass ceramic radiant tube 10. As used herein, ceramic tube means a silicon carbide, SiC, tube. Testing done to date indicates that reaction bonded SiC tubes have permeability characteristics adequate for the use disclosed herein. Specifically, Coors SCRB 210 tubes were tested in the development program. Advancements in SiC tubes are continuing to occur and alpha sintered SiC tubes may be particularly applicable to the installation discussed herein. Accordingly, the term "ceramic" as used in referring to the radiant tubes used herein and as used in the claims means any and all silicon carbide tube compositions.

Referring still to FIG. 1, the partial sectioned view discloses a single-ended, double-pass radiant tube. Those skilled in the art will understand that this arrangement includes a ceramic outer tube 12 which is closed at its end 14 which extends into the furnace and which receives a ceramic, open ended, inner tube 13. Inner tube 13 extends longitudinally a greater distance outside of the furnace than outer tube 12 where it is clamped to a burner (not shown—see FIG. 3). Conventionally, the burner includes a gas supply tube 15 which extends longitudinally and concentrically within inner tube 13. In operation, combustion air is injected into the annulus 16 in between inner tube 13 and gas supply tube 15 and mixes with the gas supplied to gas supply tube 15 when the gas exits the tube. The hot products of combustion thereafter travel down inner tube 13 until they are dead-ended at the closed end of outer tube 12. The gases then pass through the annular exhaust space 18 between inner and outer tubes 12, 13 where they are subsequently exhausted to the stack. The length of gas tube 15 is controlled to produce a heat release point within the furnace and various mixing schemes are employed so that the heat is uniformly released along the length of inner tube 13 within the furnace enclosure. This is a preferred form of radiant heat since the products of combustion initially heat inner tube 13 which in turn radiates the heat to outer tube 12 and to the work while the exhaust gas likewise heats outer tube 12. Further, in a single-ended, double-pass radiant tube 10, only one opening is required in the furnace.

The sealing arrangement for inner tube 13 is not critical and can be effected by any conventional, fibrous seal firmly compressed against the flange end of inner tube 13 because inner tube 13 being open ended and disposed within outer tube 12 is free to thermally expand and distort in exhaust space 18. More importantly, because inner tube 13 is sealed within outer tube 12 should inner tube 13 crack, i.e. fail, there is no adverse effect on the operation of the radiant tube. Accordingly, the concern is to seal outer tube 12 in a manner which prevents the outside ambient atmosphere from entering the furnace and vice versa and to effect such seal without outer tube 12 cracking or failing when it is heated.

To avoid any confusion, a space must exist between outer tube 12 and the furnace where outer tube 12 passes through the furnace and this space, indicated by reference numeral 19, must be sealed. Outer tube 12 has, at its open axial end, an annular flange 20 which in turn has an annular underside surface 21 and an annular, axial end face or outside surface 22. In the prior art sealing arrangement shown in FIG. 1, an tubular support flange member 25 extends externally of furnace casing 26. Secured to the interior of furnace casing 26 by any conventional means is insulation 27, preferably ceramic fibrous insulation. Annular support flange member 25 is secured to furnace casing 26 by any conventional means, i.e. welding, at one axial end thereof and at its opposite axial end has an annular, radially outwardly extending flange end 29 which in turn has an annular, axial end face surface 30 facing or adjacent annular underside surface 21 of outer tube 12. An annular tubular burner support member 32 has at one of its axial ends a radially outwardly extending burner flanged end 33 which in turn has an annular, axial end face surface 34 adjacent or facing outside surface 22 of outer tube 12. An annular, conventional fibrous seal 35 is disposed between underside surface 21 of outer tube 12 and axial end face surface 30 of tubular support flange member 25. Similarly, a fibrous seal 35 is disposed between outside surface 22 of outer tube 12 and axial end face surface 34 of tubular burner support member 32. A spring tension clamp mechanism pulls burner flange end 33 and support flange end 29 together to supposedly clamp and seal shoulder flange 20 of outer tube 12. The clamp mechanism shown includes a plurality of bolts 37 extending through aligned openings in burner flange end 33 and shoulder flange end 29 with each bolt 37 carrying a spring 38 compressed between fastener end and flange to exert a precompressed spring force to fiber seal 35. The prior art sealing arrangement of FIG. 1 employing fiber seals 35 cannot vacuum seal outer tube 12. Leakage past fiber seals 35 will always occur irrespective of the tensioning force placed on springs 38 unless springs 38 are compressed solid but when this occurs, outer tube flange 20 will crack. Because of the inability of the prior art mechanism to non-destructively seal outer tube 12, the present invention was developed.

Inherently, there are similarities between any sealing mechanism and, for this reason, the prior art was described in detail and reference numerals used in FIG. 1 will describe like parts and components of the present invention so that the different inventive aspects of the invention can be more readily ascertained.

Figure 2:
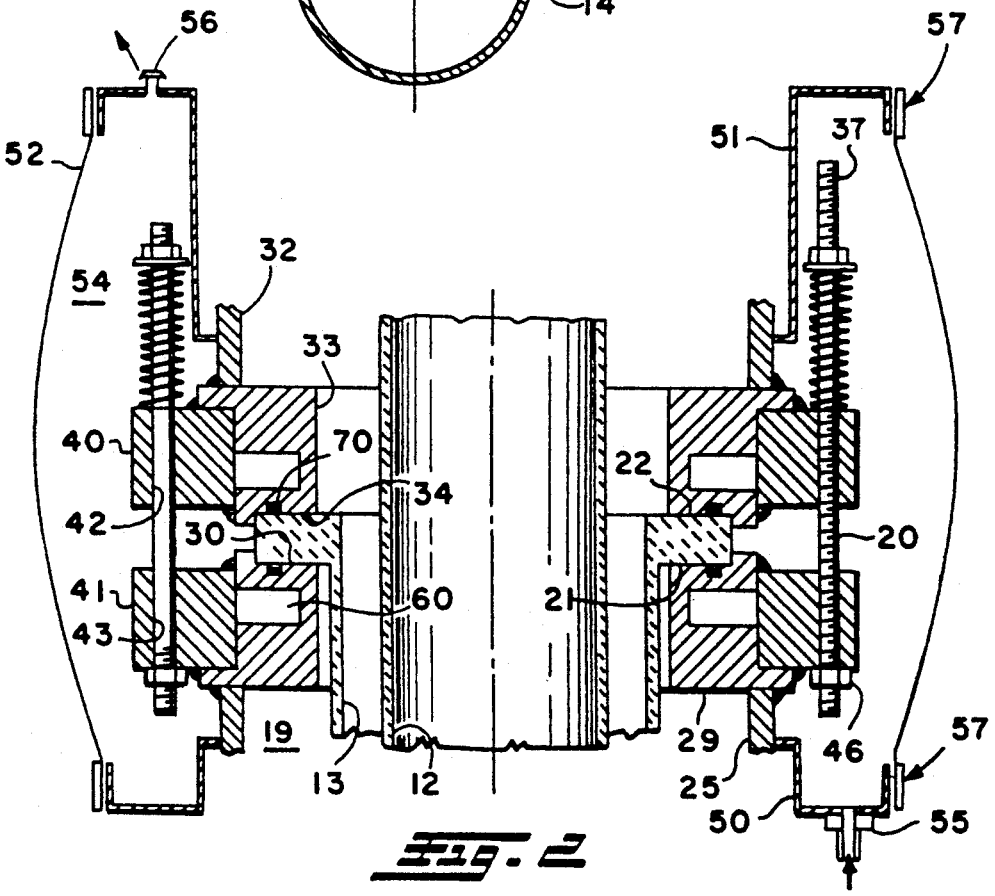
FIG. 2 is a partial schematic, longitudinally-sectioned view of a radiant tube similar to FIG. 1 showing the sealing arrangement of the present invention.

Referring now to FIG. 2, there is shown a sealing arrangement for inner ceramic tube 12 disposed within outer ceramic tube 13 having a radially outwardly extending shoulder or flange 20 which in turn has an annular underside surface 21 and an outwardly facing annular outside surface 22. A tubular support member 25 has a radially extending flange end 29 with an especially configured annular axial end face surface 30 facing tube underside surface 21. A tubular burner support member 32 has a burner support flange end 33 which in turn has an especially configured axial end face surface 34 facing tube outside surface 22. A clamp mechanism similar to that employed in prior art FIG. 1 is utilized but produces different results as explained hereafter. More specifically, in the fabrication shown in FIG. 2, a radially outwardly extending annular shoulder 40 extends from burner flange end 33 and a similar radially outwardly extending shoulder 41 extends from support flange end 29. A plurality of circumferentially spaced longitudinally extending openings 42 are drilled in burner flange annular shoulder 40. Similarly, a like plurality of identically circumferentially spaced longitudinally extending openings 43 are drilled in support flange annular shoulder 41. Openings 42, 43 are aligned with one another and a plurality of threaded studs 37 or bolts extend through openings 42, 43. Compression spring 38 fits over one of the ends of stud 37 and fasteners 46 applied to the axial ends of each threaded stud 37 compresses spring 38 against one of the fasteners 46 and an associated flange shoulder 40 or 41 to clamp support flange end 29 against burner flange end 33 compressing or sandwiching radiant tube flange 20 therebetween. It is to be noted that the clamp arrangement is radially outward or outboard of radiant tube's flange 20 and exerts a bearing pressure on flange 20. As described thus far, the invention is similar to the prior art.

An optional diaphragm feature is shown in FIG. 2. This optional feature includes a furnace side annular housing 50 secured to support flange member 25 beneath support flange end 29 and a burner side annular housing 51 is similarly applied to annular burner flange end 32 which longitudinally extends away from burner flange end face 33. A diaphragm 52 is clamped between furnace side housing 50 and burner burner sill housing 51 with strap clamps 57 to define a sealed, purged gas space 54 which annularly extends about support flange member 25 and tubular burner support member 32. A purge gas inlet 55 is provided in one of the annular housings 50, 51 and similarly, a purge vent is also provided in one of the annular housings 50, 51. It is contemplated that a purge gas, i.e. an inert gas such as nitrogen, at a slight pressure of say 2–3 inches water column would fill purge gas space 54 and should leakage, (i.e. a vacuum leakage past the seal) through furnace space 19 occur, the purge gas would be drawn into the furnace chamber where it would do no harm to the heat treat process. This again is an optional feature and is not necessary for the sealing arrangement of the present invention. It can, however, be used in conjunction with the prior art seal disclosed in FIG. 1 for vacuum application. If used in the prior art seal shown in FIG. 1, appropriate valving would have to be applied to purge gas inlet 55 since there would be a constant draw of the purge gas into the furnace chamber resulting from leakage from fiber seals 35. If use with the present invention, diaphragm 52 would be a fail-safe feature.

Figure 5:
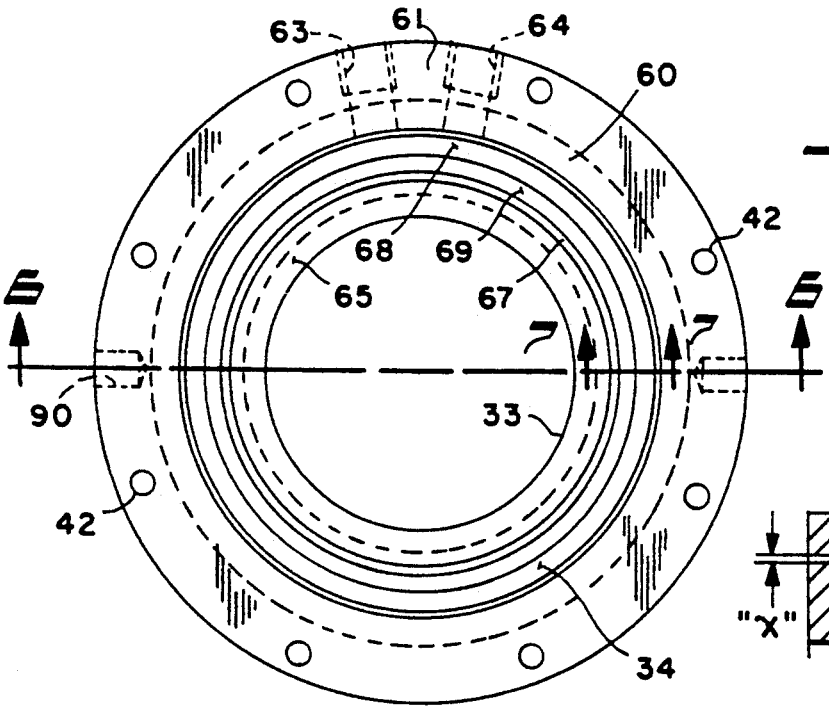
FIG. 5 is an end view of the burner flange employed in the present invention.
Figure 7:
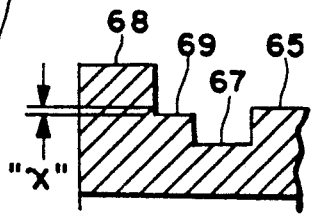
FIG. 7 is a detail of the burner flange taken along line 7—7 of FIG. 5.
Figure 6:
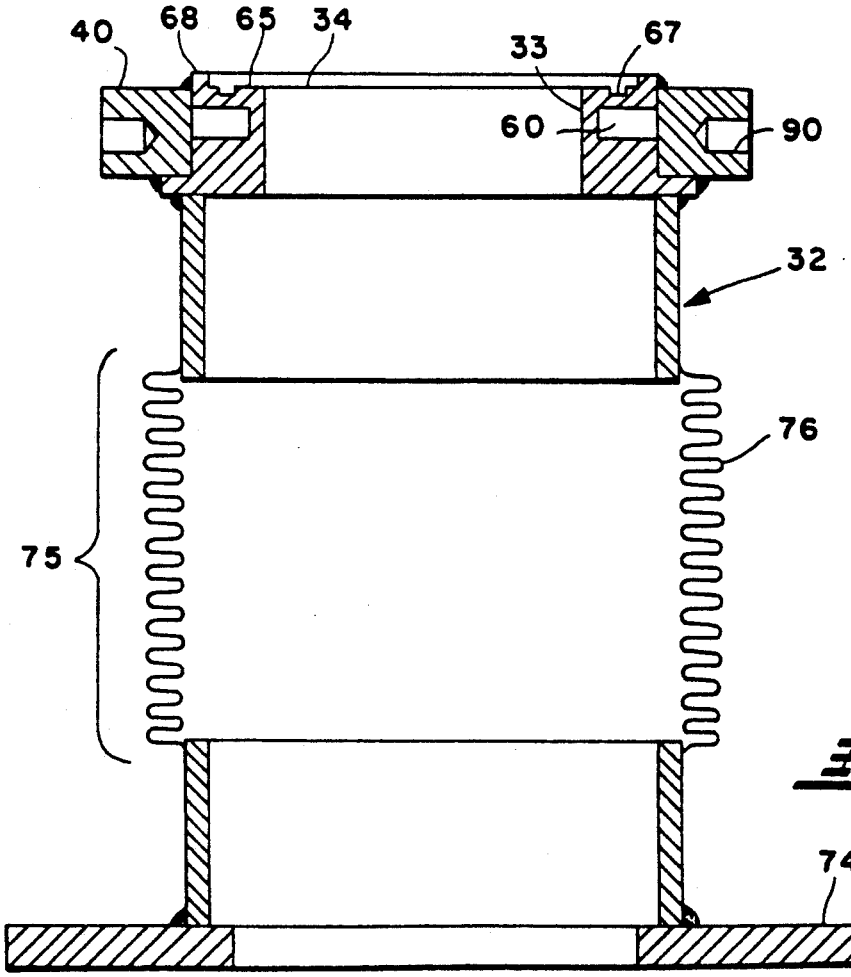
FIG. 6 is a longitudinally sectioned view of the burner flange taken along line 6—6 of FIG. 5.

Referring now to FIGS. 2, 5, 6 and 7, the construction of burner flange end 33 and annular, axial end face surface 34 of tubular burner support member 32 is identical to the construction of annular support flange end 29 and annular axial end face surface 30 of tubular support member 25. Thus, it will be sufficient to describe burner flange end 33 as shown in FIGS. 5, 6 and 7 with the understanding that the same construction applies to support flange end 29. More specifically, burner flange end 33 has a water jacket 60 in the form of a large recess which almost totally circumscribes burner flange end 33. As best shown in FIG. 5, a land 61 extending across water jacket 60 makes the water jacket discontinuous. On each side of land 61 is a tapped water port, one port 63 being an inlet and the opposite port 64, being an outlet or vice versa. Again, as noted in the background, water jackets are conventional. It should also be noted that water jacket 60 is positioned close to burner axial end face surface 34.

Axial end face surface 34 includes a radially inward position annular contact surface 65 which extends to the inside diameter of tubular burner support member 32. Adjacent annular contact surface 65 and extending radially outward therefrom is a longitudinally recessed sealing groove 67 and spaced radially outwardly from sealing groove 67 is a longitudinally protruding shoulder 68. Extending radially between annular shoulder 68 and annular sealing groove 67 is an annular recess surface 69. Significantly, recessed surface 69 is longitudinally recessed relative to contact surface 65 as best shown by dimension X in FIG. 7. Positioned within sealing groove 67 is an elastomer seal 70 (shown in FIG. 2) which can be a conventional O-ring made of silicon rubber. With the design illustrated in FIGS. 5, 6 and 7 and the temperature of the furnace chambers at about 2000° F., water jacket 60 reduced the temperature of elastomer seal 70 to about 300+° F. and at this temperature, the seal will not thermally degrade.

In order for elastomer seal 70 to effectively seal radiant tube flange 20, seal 70 must be positioned radially outward from annular contact surface 65. As noted above, the clamp mechanism positioned outboard of seal 70 exerts what could be viewed as a bending moment on burner and support flange ends 29, 33. By providing recess surface 69, the moment is resisted by contact surface 65 bearing against tube outside surface 22 (and for support flange member 25, tube underside surface 21). Contact surface 65 must be milled smooth and the finish of annular underside surface 21 and annular axial end face surface 22 of outer tube 12 must also be smooth. Further, a vacuum sealing grease such as Dow Corning Vacuum Sealing Grease, is used to fill in any surface imperfections between flange and radiant tube, not for the purpose of establishing a vacuum seal between tube and flange, but to establish a smooth continuous contact area between the surfaces which are tightly engaged by the radially outboard compression mechanism discussed above. What the contact area does then is to permit the elastomer seal 70 to be compressed in groove 67 with material flow of the seal extending into the space between tube flange and recess surface 69 so that seal 70 need only function to seal the radiant tube. Stated another way, the metal-to-ceramic tube-flange contact over its entire area prevents any movement between tube and flange which would otherwise upset the sealing capabilities of elastomer seal 70. Tube-flange movement will not only wear seal 70 to produce vacuum leakage, but could also upset seal 70 to produce leakage. It is important then that contact surface area 65 be made as large as possible and it is preferred for the furnace application under discussion that the radiant tube diameter be 6". The invention has worked with radiant tubes of 3⅝" diameter but larger tube sizes, preferably in tube diameters of about 6", enhances the sealing characteristics of elastomer seal 70.

Figure 3:
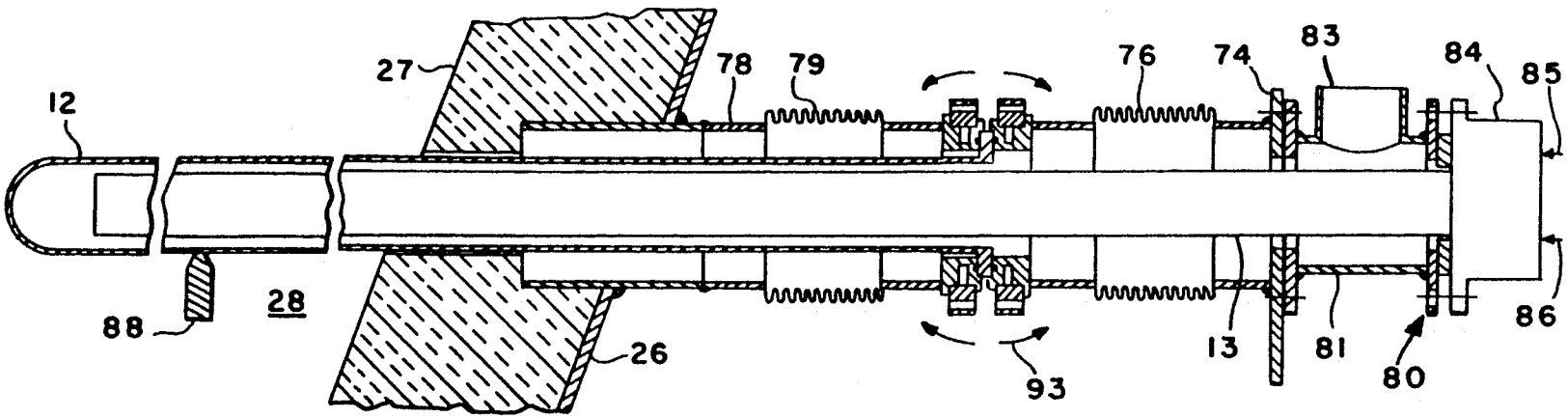
FIG. 3 is a schematic, longitudinally-sectioned side view of the sealing arrangement of the present invention.

As best shown in FIG. 6, tubular burner support member 32 has an annular support plate 74 or other means of gas tight attachment formed at its axial end opposite burner flange end 33. A cylindrical body section 75 extends between support plate 74 and burner flange end 33. Within body section 75 is a conventional expansion joint 76 or bellows. Similarly, as best shown in FIGS. 3 and 4, tubular support member 25 likewise has a cylindrical body section 78 extending between its axial ends and body section 78 in turn has an expansion joint 79 as part thereof. Expansion joints 76, 79 permit an articulated joint connection to be applied to the tube mounting arrangement to reduce tube stress when the radiant tube is mounted in a horizontal direction. The articulated joint connection can also be applied if the radiant tube is mounted in a vertical direction to likewise reduce tube stress due to unplanned externally applied forces. It is possible because of the rigidity of expansion joint 79, 76 to support outer tube 12 solely on these expansion joints by the arrangement illustrated assuming some support for exhaust/burner housing 80. However, such an arrangement will exert a bending stress on outer tube 12 and at the temperature ranges at which the furnace is to be operated, i.e. furnace temperatures approaching 2350° F. require flame temperatures within the radiant tube as high as 2700°–2800° F. resulting cumulative thermal-support-bending stress which could result in premature failure of outer tube 12.

The radiant tube horizontal mounting position is shown in FIGS. 3 and 4. In FIG. 3, which is a side view of the arrangement, the articulated joint connection is not shown for drawing clarity purposes. The articulated joint connection is shown in the top view illustrated in FIG. 4. Support plate 74 is conventionally mounted to an exhaust/burner housing 80 which includes an exhaust section 81 having an outlet 83 connected to the stack for exhausting products of combustion in a known manner. Exhaust/burner housing 80 also has a burner section 84 sealingly fastened to exhaust section 81. Plumbed into burner section 84 is a gas line 85 for a gaseous fuel and an air line 86 for combustion air. The axial end of inner tube 13 is sealed by a conventional, fibrous ceramic seal when exhaust section 81 and burner section 84 are bolted together. This is a conventional seal arrangement for inner tube 13. In the schematic illustration shown in FIG. 3, it is to be understood that the furnace casing portion 26 illustrated is the end wall of a cylindrically shaped furnace which end wall is spherical in configuration. Interiorly of furnace casing 26 and furnace insulation 27 is a cylindrical furnace chamber indicated schematically by reference numeral 28 and within furnace chamber 28 is a radiant tube support indicated schematically by reference numeral 88.

To minimize tube stress, an articulated joint connection is provided to support outer tube 12 in a horizontal direction while permitting outer tube 12 to move freely in a lateral or orthogonal direction. As best shown in FIGS. 5 and 6, two diametrically opposed pivot pin holes 90 are drilled into annular shoulder 40 of burner flange 33. Alternatively, pivot pinholes 90 could be drilled into support flange end 29 of support flange member 25 and, in fact, in the view shown in FIG. 4 pivot pinholes 90 are placed in support flange 29 and not in burner flange 33. Referring to FIG. 4, two diametrically opposed support bars 92 extend from support plate 74 and are fixed such as by welding to furnace casing 26. This fixes the distance that tubular support member 25 and tubular support burner member 32 with outer ceramic tube 12 clamped therebetween extends from furnace casing 26. Each support bar 92 has a pivot support plate 93 mounted thereto by means of fasteners 94 and spacers 95. Slotted holes in support plate 93 and/or support bars 92 (not shown) are provided for adjustment. Extending from each pivot support plate 93 is a pivot pin 96 which fits within pivot pinhole 90. Thus, in the top view shown in FIG. 4, pivot pins 96 provide a support for the outer tube's flange 20 while permitting the support flange 29 of support flange member 25 to pivot in the direction shown by reference numeral arrows 93 in FIG. 3. This direction, as noted above, is orthogonal to the axis or more precisely the to axes at which pivot pins 96 support outer tube 12. The support can be totally rigidized by providing two additional, diametrically opposed support bars offset 90° from support bar 92 shown and corresponding pivot pin and pin recesses provided in a flange end. However, this defeats the joint connection desired.

Figure 4A:
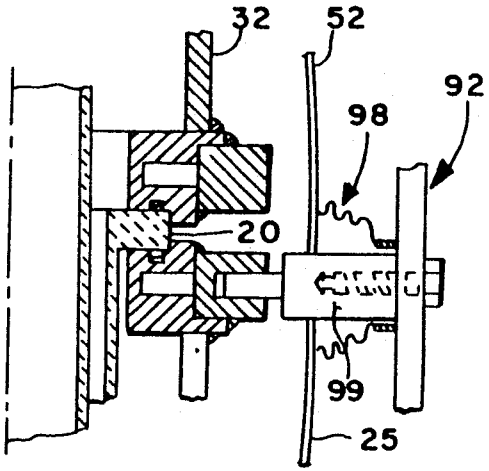
FIG. 4A is a schematic partially sectioned view of an alternative embodiment of the mounting arrangement shown in FIG. 4.
Figure 4:
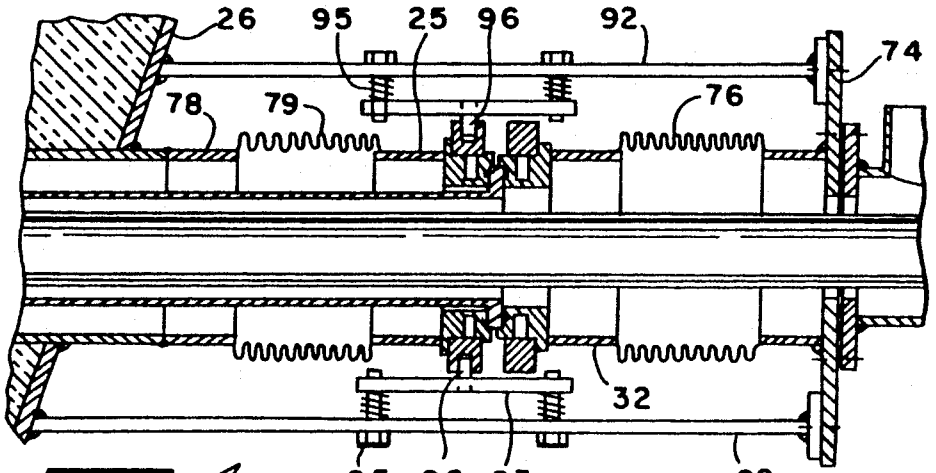
FIG. 4 is a partial schematic, longitudinally-sectioned top view of the sealing arrangement of the present invention similar to that shown in FIG. 3.

Alternately, as shown in FIG. 4A, pivot support plates 93 may be replaced by singularly bolted support posts 99. The cylindrical contour of these posts may be better suited for sealing to a diaphragm 52 described earlier with reference to FIG. 2. An elastomer boot 98 vulcanized or glued to diaphragm 52 and clamped around post 99 would accommodate a small pivoting motion of radiant tube flange 20 while maintaining the slight positive gas pressure within diaphragm 52.

Figure 8:
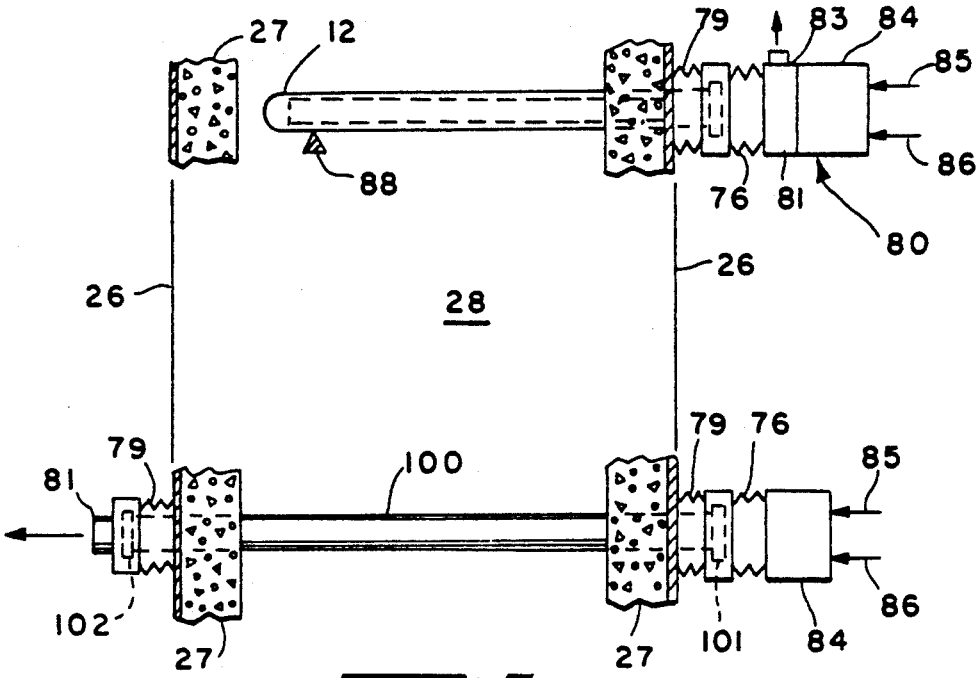
FIG. 8 is a schematic view of both a single-ended double-pass radiant tube and a single-pass radiant tube using the present invention.

The sealing arrangement for the radiant tube of the present invention has been discussed with reference to a radiant tube of the single-ended, double-pass type. This is again illustrated schematically in the top portion of FIG. 8. The invention is also applicable to a radiant tube of the single-pass type 100 also illustrated schematically in FIG. 8. In the single-pass application, one ceramic radiant tube 100 has a flanged axial inlet end 101 which is the same as that described for outer tube 12 in the single-ended, double-pass type and also, an identical axial outlet flanged end 102 is provided at the opposite of tube 100. In the preferred mounting arrangement for ceramic tube's inlet flanged end 101, there is provided a support flange member expansion joint 79 and a burner flange member expansion joint 76 which in turn has a support plate to which burner section 84 is provided. Support bars 92 can be provided to the burner flange support plate as described with reference to FIGS. 3 and 4 and an articulated joint connection provided. With respect to sealing outlet flanged end 102, it is sufficient to provide on one side of outlet flanged end 102, support flange member 25 with expansion joint 79 and on the opposite side of axial outlet flanged end 102 to provide exhaust section 81 which can be sealed by a conventional fibrous gasket. In fact, it is not necessary to have expansion joint 79 for tube outlet end 102 and an alternative arrangement is shown in FIGS. 9 and 10.

Figure 10:
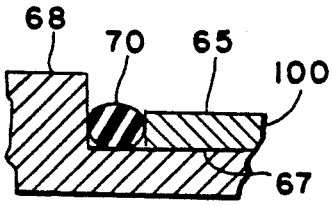
FIG. 10 is a detail of the flange shown in FIG. 9 similar to that illustrated in FIG. 7.
Figure 9:
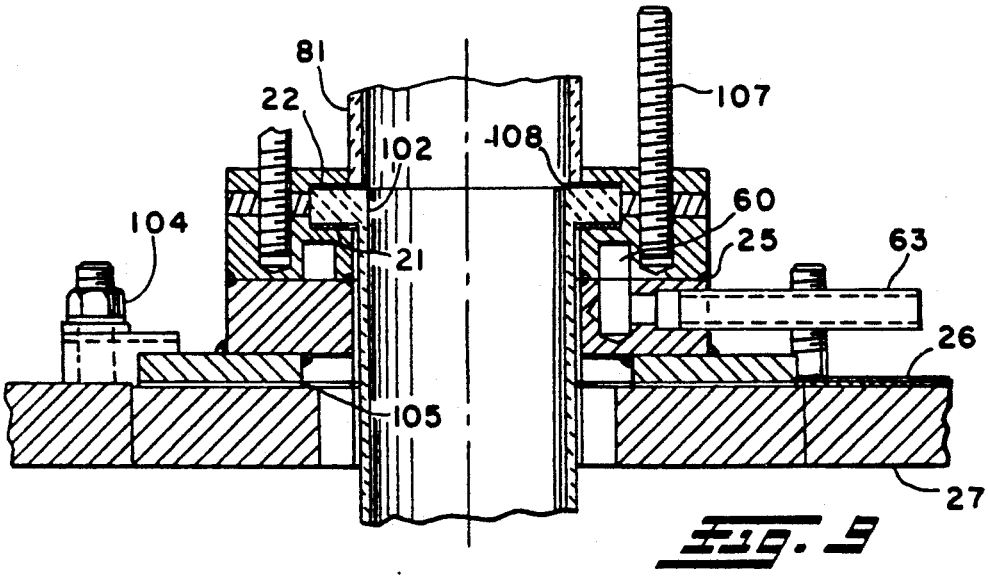
FIG. 9 is a partial, longitudinally-sectioned view similar to FIGS. 1 and 2 showing an alternative embodiment of the present invention.

Referring now to FIGS. 9 and 10, reference numerals previously used to describe parts and components of the sealing arrangement will be used again to describe the same parts and components where possible. In the single-pass ceramic radiant tube mount arrangement illustrated, tubular support flange member 25 is a composite sold block arrangement clamped by fasteners 104 to furnace casing 26 and sealed thereto by means of conventional fibrous ceramic gasket 105. Formed in support flange member 25 is water jacket 60 and water inlet 63 to water jacket 60 is illustrated. Rigidly clamped by means of threaded fasteners 107 threadedly received in tapped holes (fastener nuts not being shown) is exhaust section 81. A conventional annular ceramic fibrous washer 108 seals outside surface 22 of outlet flange 102 with exhaust section 81. Elastomer seal 70 is used to seal tube's underside surface 21 with axial end face surface 30 of support flange member 25 as discussed in the preferred embodiment. A slightly different arrangement is used to effect the seal in this alternative embodiment and is best shown in FIG. 10. In FIG. 10, the groove recess 67 illustrated in FIG. 7 extends from shoulder 68 to the inside diameter of support flange member 25. A non-ferrous metallic washer 110 such as brass or copper rests on groove surface 67 and extends from the inside diameter of tubular support flange member 25 radially outwardly to a position similar to that where groove 67 would begin in FIG. 7. The face surfaces of washer 110 are softer than the steel of support flange member 25 and assures the desired surface contact area between tube and flange member and this occurs whether or not vacuum grease is applied to washer 110. The arrangement however, without the application of vacuum grease is not as good, from a sealing consideration, as the arrangement with the application of vacuum grease. Elastomer seal 70 is compressed in the space between the outer circumferential edge of washer 110 and shoulder 68 and because movement does not occur between radiant tube and washer 110, seal 70 is effective to prevent vacuum leakage. It is noted that the clamp pressure is again exerted radially outward of seal 70 to produce pressure on washer 110.

Figure 11:
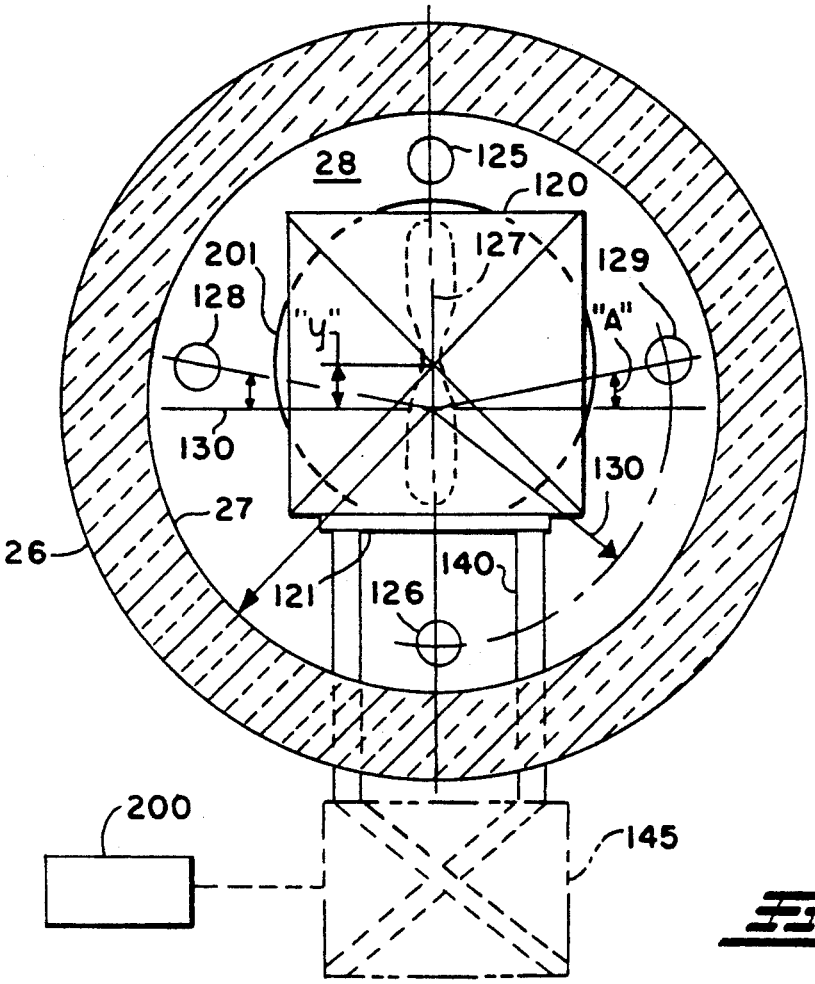
FIG. 11 is a schematic, cross-sectioned end view of a furnace showing the position of the radiant tubes relative to the work and to the furnace.

Referring now to FIG. 11, there is shown in schematic representation a cross-sectional slice of the furnace employing the radiant tubes looking endwise into the furnace. As noted in the discussion above, the sealing arrangement for the radiant tube becomes critical because a slight vacuum (10–250 torr) is pulled in the furnace. While the invention could be applicable as a sealing arrangement for a standard atmosphere, box type furnace, its specific application is for use in a vacuum furnace constructed in accordance with conventional type, fibrous ceramic insulation applied to a relatively thin walled furnace casing 26 (approximately ¼-½" plate). This construction can withstand high temperatures under consideration while generating temperatures of about 400° F. at the furnace casing 26. Because a vacuum is pulled, the furnace preferably has a spherical or cylindrical shape and because capacity requirements dictate loading the workpieces into rectangular work trays or baskets 120, the furnace is preferably cylindrical. (In "hard vacuum" applications, the furnace or vessel configuration is usually spherical or cylindrical because such shapes are best able to resist vacuum deformation. In the "soft vacuum" application under discussion, a rectangular or box furnace configuration could have sufficient structural integrity to withstand vacuum levels under discussion. However, heat transfer considerations as well as aesthetics dictate a cylindrical or spherical configuration.) The end wall of the furnace (FIGS. 3, 4) is preferably spherical and the door (not shown) can be either flat or spherical. For process requirements discussed more fully in the GRI report incorporated herein by reference, the temperature of the furnace must be significantly higher than the temperature at which standard atmosphere furnaces operated and considerably higher than even the super high temperature furnaces recently marketed such as Surface's Ultracase furnace (2350° F. versus 2050° F.). Now in order to achieve the heat cycle for heating, both for process and commercial considerations, a tremendous amount of heat must be ramped or input into the radiant tubes to achieve the desired heat rate. This translates into a temperature within the tube as high as 2750° F. At the same time, there is a strict temperature uniformity requirement placed on the process which basically states that the temperature spread between hottest point and coldest point on any surface of the rectangular block, i.e. work basket 120, cannot deviate more than 10° F. In a hard vacuum furnace where the work is heated in vacuum without introduction of atmosphere, graphite electrodes can be placed in various configurations, several of which are patented, to circumscribe basket 120 and uniformly heat the work at the 2350° F. temperatures under discussion. When this is done, the furnace is lined with heat shields to minimize the cold spot resulting from the water cooled walls and to provide some means for re-radiating the heat from the graphite heating elements. As indicated above, in the "soft" vacuum application under discussion, the atmosphere must be constantly purged. That is, heating has to occur in the presence of a furnace atmosphere and that furnace atmosphere can eventually have a deleterious effect on the graphite heating elements. Thus, if heating elements were used in a "soft" vacuum application, they would have to be shielded and encapsulated within the bayonet type radiant tubes. They could not surround the work. In standard atmosphere furnaces of box type configurations, the radiant tubes are placed adjacent the box side walls but the temperatures at which the furnaces operate are considerably less and convection arrangements can be used to distribute the heat to achieve uniformity. At the super high temperature ranges under discussion, heating by convection is insignificant. Thus, the heat input by conduction of the temperature ranges under discussion is unique to the application under discussion. However, it is known from work by Surface Combustion on a cylindrical furnace with fibrous insulation of the type under discussion herein, that radiant tubes centered about the axis of the work and also centered about the axis of the cylindrical furnace will achieve temperature uniformity at least at the temperature ranges of the prior art. That is, the concept of the cylindrical, continuously insulated furnace for re-radiating heat, with or without heat reflecting shields, by a load furnace centered tube arrangement has been recognized. However, at the elevated temperature ranges under consideration in a soft vacuum application, the heat sink characteristics of hearth 121 become significant at the upper temperature ranges.

To compensate for the heat sink effect of hearth 121 and the constrictions placed on radiating heat to the work because of hearth posts 140, a radiant tube position has been developed which position is contrary to that one would expect to occur based on existing, computer simulated heat models and the like. In the tube position disclosed in FIG. 11, the number of tubes is minimized in number to four so as to correspond to the four faces of the rectangular work 120. This means that for the heat input required, the diameter of radiant tubes are sized to about 6" in diameter. This, incidentally, has the additional benefit of increasing the contact area of the sealing mechanism described above which then enhances the vacuum sealing characteristics of the seal arrangement. Hearth 121 is then raised relative to the longitudinal centerline of the furnace and the tubes are positioned on the centerlines of the work. This means that the radiant tubes are spaced at unequal circumferential increments about the furnace.

More specifically, the center of work 120 is offset vertically upward from the center of furnace insulation 27 by a distance indicated by reference letter Y in FIG. 11. Top most radiant tube 125 and bottom most radiant tube 126 are centered on vertical axis 127 of load 120 which coincides with the vertical axis of furnace casing 26. Importantly, bottom radiant tube 126 is centered between the posts 140 of hearth 121, and spaced a distance "y" further away from work 120. This provides additional heat at the bottom of work 120 where radiation is somewhat constricted by hearth posts 140. However, side radiant tubes 128, 129 are centered relative to the horizontal axis of work 120 which is offset from the horizontal centered axis 130 of the furnace a distance Y". Stated another way, side radiant tubes 128, 129 are shifted an angle designated as "A" in FIG. 11 towards top most radiant tube 125. Thus, relative to furnace casing 26, the circumferential angle between top most radiant tube 125 and side radiant tubes 128, 129 is equal to $90° - A°$ while the arcuate spacing between side radiant tubes 128, 129 and bottom most radiant tube 126 is equal to $90° + A°$. Radiant tubes 125, 126, 128 and 129 are centered on an imaginary arc 130 which is struck from the longitudinal center of the furnace so that each radiant tube is positioned an equal distance from the inside of furnace insulation 27 with the result that furnace insulation 27, to the extent heated by the four radiant tubes in turn radiates heats uniformly to work 120 which is not positioned at the center of the furnace. Longitudinally, single-ended, double-pass radiant tubes extend slightly past the lengthwise edges of the work (not shown) to assure uniform heating of the work edge. The arrangement provides uniform heat within tolerances at the desired rates because the hearth radiation view has been compensated and the cylindrical configuration of continuous insulation 27 provides effective re-radiation of the heat to the work without the necessity of radiation shields and the like. A specific example is as follows: for a load or work basket 120 having 36"×36" dimension with the furnace having an inside diameter of 72" and the tubes placed on arc radius 130 of 30", vertical offset dimension Y would be 5½" resulting in an angle A of 10 ½°.

Figure 12:
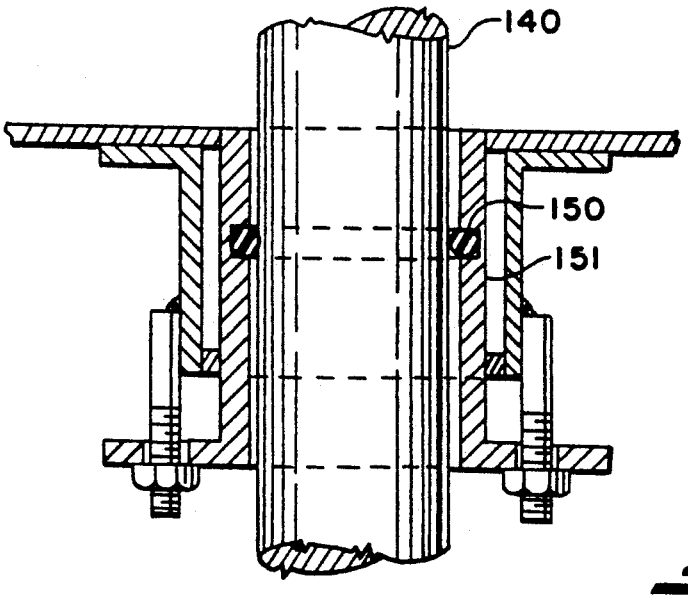
FIG. 12 is a schematic view similar to FIG. 3A of U.S. Pat. No. 4,802,844 showing a seal for the hearth post shown in FIG. 11.

Because the work generally comprises loose pieces placed in a basket 120 which may or may not be filled, hearth 121 is contemplated to be movable, for example by a scissors type lift mechanism indicated schematically by reference numbers 145. Lift mechanism 145 permits adjustments to be made to vertical dimension "y" depending on the work load and during the heat cycle the distance y" can be adjusted to achieve the desired uniformity by correcting for the radiation arising from lowermost hearth tube 126. Reference should be had to Surface Combustion U.S. Pat. No. 4,802,844, assigned to GRI, for an example of the scissors lift mechanism 145 used in FIG. 10. Post 140 would extend outside of furnace chamber 28 thus making the hearth function as a heat sink requiring the compensation set forth above. The rope seal mechanism shown in FIG. 3A of the '844 patent which is reproduced and modified as FIG. 12 would be replaced by an elastomer seal 150 (or a plurality of such seals because of wear) coupled with a water jacket 151 to maintain the vacuum in furnace chamber 28.

In a normal heating cycle the work of course should be heated to process temperature in the quickest time. It is known that heat transfer can be best effected by convection at low temperatures and by radiation at high temperatures. Convection can be accomplished in the cylindrical furnace configuration by mounting a fan in the furnace end wall. Such an arrangement is disclosed in Surface Combustion U.S. Pat. No. 4,963,091 dated Oct. 16, 1990 and reference should be had to FIGS. 2 and 3 of the Surface patent, incorporated by reference herein, for a cylindrical furnace construction of the type utilized in the furnace under discussion herein. In the '091 patent, a fan in the end wall of the furnace is used to convectively heat the work with the work vertically centered within the cylindrical furnace. This arrangement gives the best uniformity of heat transfer at the low temperature end in the fastest time possible. Importantly, using convection during the initial heating of the work reduces, or eliminates, temperature gradients within the work and this helps during radiation heating of the work at the high temperature end of the cycle in the sense that the radiation heating maintains rather than establishes temperature uniformity.

Accordingly, pursuant to the discussion above, a typical heat cycle using a movable hearth would be as follows:

| HEAT CYCLE | | | |
|---|---|---|---|
| Hearth Position | Work Temperature | Convective Heat Transfer (Fan Speed) | Pressure |
| Centered | 70°-500° F. | High | Atmospheric to Positive Pressures |
| Centered | 500°-1000° F. | Medium | Slight Sub-Atmospheric |
| Raised | 1000°-Final Heat | None (Slow Fan Rotation) | Soft Vacuum |

In the heat cycle depicted above, the fan would rotate at high speeds to achieve fast convection heat transfer with the furnace chamber at positive pressure as set forth in Surface's '091 patent. As the work begins to heat, the fan speed is reduced and a very slight negative pressure is pulled in the furnace chamber from a vacuum pump (not shown), i.e. 30 inches of water column. At this slight negative pressure, convection can still occur, but at a reduced rate while heating by the radiant tubes becomes more pronounced. However, the work still remains vertically centered within furnace chamber 28. Once this transition stage is completed, the soft vacuum is pulled and the hearth is raised to its FIG. 11 position to achieve good temperature uniformity by radiation. For such applications, the fan would have to be constructed of high temperature materials (conventional high temperature fans are available) and the fan would have to continue rotating even during final heating to avoid blade wrappage. A conventional microprocessor 200, illustrated schematically in FIG. 11 is used to coordinate and control the speed of the fan (not shown but shown and described in '091); the position of hearth 120; the pressure within furnace chamber 28 by means of a conventional vacuum pump (not shown) and all functions would be controlled depending upon the temperature of the work 120 measured by conventional means such as a thermocouple or pyrometer (not shown). The pump, high speed fan, thermocouple, etc. are all conventional items readily available to the trade and are not shown or described in detail herein. A baffle plate 201 as more fully described in the '091 patent is spaced adjacent one axial end of furnace chamber 28 and radiant tubes 125, 126, 128, 129 extend within the annular space between baffle plate 201 and the interior of the furnace casing. Fan blade 202 is shown in phantom lines behind work 120.

The invention has been described with reference to a preferred embodiment and at least one alternative embodiment. Obviously, modifications and alterations will occur to those skilled in the art upon reading and understanding the description of the invention set forth herein. It is intended to include all such modifications and alterations insofar as they come within the scope of the invention.

Having thus defined the invention, it is claimed:

1. An industrial, heat treat vacuum further for heating work placed therein comprising:

a steel furnace casing formed as a horizontally extending cylinder having a door at one axial end and a closed end wall at its opposite axial end; fibrous, continuous insulation attached to said casing and defining a cylindrical chamber formed thereby, said furnace chamber symmetrical about a horizontally extending furnace centerline;

four ceramic radiant tubes of the single-ended, double-pass type extending into said furnace chamber through said end wall; vacuum sealing means for sealing said tubes to said end wall; said four tubes including a lowermost tube, a top tube and two side tubes on either side of said work;

a hearth carrying work thereon including laterally spaced posts extending into said chamber; hearth lift means for variably raising and lowering said posts to any one of several vertical positions and specifically to a position whereat the center of said work is vertically offset from said furnace centerline towards the top of said furnace chamber; and said lowermost tube positioned between said posts underneath said work and centered with respect to said work, said top tube adjacent to and centered with respect to the top surface of said work while spaced vertically closer to said work than said bottom tube; and said two side tubes vertically centered with respect to said work and offset with respect to said furnace chamber's centerline whereby said work is uniformly heated.

2. the furnace of claim 1 wherein said hearth lift means is further actuated while said work is being heated to position said work from a generally centered position to said vertically offset centered position when said work is being heated at temperatures higher than 1000° F. whereby said furnace attain's temperature uniformity within said work.

3. The furnace of claim 2 further including fan means for circulating furnace atmosphere within said chambers; pump means for controlling pressure within said furnace chamber; and control means for activating said fan means and maintaining said furnace chamber at positive pressure while controlling said hearth means to center said work within said furnace chamber until said work is heated to a predetermined temperature and thereafter activating said pump means to draw a vacuum in said furnace chamber while activating said hearth lift means to position said work in said vertically offset position within said furnace chambers.

* * * * *

UNITED STATES PATENT AND TRADEMARK OFFICE

CERTIFICATE OF CORRECTION

PATENT NO. : 5,224,857

DATED : July 6, 1993

INVENTOR(S) : Thomas J. Schultz, Timothy J. Kuhn

It is certified that error appears in the above-indentified patent and that said Letters Patent is hereby corrected as shown below:

Column 3, line 53, change "inwards" to --inward--.
Column 4, line 36, change "connecting" to connection--.
Column 8, line 65, change "burner burner" to --burner--.
Column 12, line 21, change "sold" to --solid--.
Column 14, line 43, change "Y"" to --"Y"--; and
line 56, change "heats" to --heat--.
Column 15, line 8, change "numbers" to --number--; and
line 11, change "y"" to --"y"--.
Column 16, line 14, change "wrappage" to --warpage--.

Signed and Sealed this

Seventeenth Day of May, 1994

*Attest:*

Bruce Lehman

BRUCE LEHMAN

*Attesting Officer*

*Commissioner of Patents and Trademarks*